US006978713B2

(12) United States Patent
Allart et al.

(10) Patent No.: US 6,978,713 B2
(45) Date of Patent: Dec. 27, 2005

(54) HYDRAULIC RADIAL PISTON MOTOR

(75) Inventors: Bernard Allart, Crepy en Valois (FR); Louis Bigo, Compiegne (FR)

(73) Assignee: Poclain Hydraulics Industrie, Verberie (FR)

( * ) Notice: Subject to any disclaimer, the term of this patent is extended or adjusted under 35 U.S.C. 154(b) by 16 days.

(21) Appl. No.: 10/499,948

(22) PCT Filed: Dec. 20, 2002

(86) PCT No.: PCT/FR02/04494

§ 371 (c)(1),
(2), (4) Date: Jun. 23, 2004

(87) PCT Pub. No.: WO03/056172

PCT Pub. Date: Jul. 10, 2003

(65) Prior Publication Data

US 2005/0126387 A1 Jun. 16, 2005

(30) Foreign Application Priority Data

Dec. 24, 2001 (FR) ..... 01 16815

(51) Int. Cl.[7] ..... F03C 1/04
(52) U.S. Cl. ..... 92/72; 91/498
(58) Field of Search ..... 91/487, 488, 491, 91/492, 498; 92/72

(56) References Cited

U.S. PATENT DOCUMENTS 4,522,110 A 6/1985 Samuelsson
5,261,318 A * 11/1993 Allart ..... 91/491

FOREIGN PATENT DOCUMENTS

| | | |
|---|---|---|
| DE | 829553 | 1/1952 |
| DE | 2634065 | 2/1978 |
| EP | 0935069 | 8/1999 |
| FR | 2587761 | 3/1987 |

* cited by examiner

*Primary Examiner*—Thomas E. Lazo
(74) *Attorney, Agent, or Firm*—Ladas & Parry LLP

(57) ABSTRACT

A hydraulic motor having radial pistons, and comprising a cam, a distributor, and a cylinder block whose cylinders are connected to communication orifices situated in a communication face of the cylinder block. The distributor has a distribution face in which distribution orifices open out that are suitable for communicating with the communication orifices while the cylinder block and the distributor are turning relative to each other. The cam is provided with a plurality of lobes, each of which has two ramps (50), each of which has a convex portion (51) and a concave portion (52). The edge of each distribution orifice has a leading portion (B1) via which communication between the distribution orifice and the communication orifices opens, and a trailing portion (B2) via which said communication closes. Each leading portion (B1) and each trailing portion (B2) of the edges of at least certain distribution orifices (21A, 23A) has an edge arrangement (53A; 53B) provided with at least one notch (54A; 54B), said edge arrangements of a distribution orifice being different depending on whether they are in angular correspondence with the convex region (51) or with the concave region (52) of the ramp of the cam.

13 Claims, 4 Drawing Sheets

HYDRAULIC RADIAL PISTON MOTOR

The present invention relates to a hydraulic motor having radial pistons, and comprising a cam and a cylinder block that are suitable for turning relative to each other about an axis of rotation. The cylinder block has radial cylinders connected via cylinder ducts to communication orifices situated in a communication face of the cylinder block that is perpendicular to the axis of rotation. Pistons mounted to slide in the cylinders are suitable for co-operating with the cam, which cam is provided with a plurality of lobes, each of which has two ramps, each of which has a convex region and a concave region. The motor further comprises a fluid distributor having a distribution face that is perpendicular to the axis of rotation and that is suitable for being in abutment against the communication face of the cylinder block, said distribution face being provided with distribution orifices comprising orifices suitable for being connected to a fluid feed and orifices suitable for being connected to a fluid discharge. The fluid distributor is constrained to rotate with the cam, so that there is one ramp of the cam that corresponds to each distribution orifice (i.e. each distribution orifice is situated in angular correspondence with a respective ramp of the cam), said distribution orifices being suitable for communicating one after another with the communication orifices while the cylinder block and the distributor are turning relative to each other, the edge of each distribution orifice having a leading portion via which communication between the distribution orifice and the communication orifices opens while the cylinder block and the distributor are turning relative to each other in a given direction of relative rotation, and a trailing portion via which communication between the distribution orifice and the communication orifices closes while the cylinder block and the distributor are turning relative to each other in the same direction of relative rotation.

For a motor of this type, operating at full cubic capacity, each communication orifice successively comes to face a distribution orifice connected to the fluid feed and comes to face a distribution orifice connected to the fluid discharge. The communication orifice in question being coupled to the distribution orifice that is connected to the feed causes the piston contained in the cylinder connected to said communication orifice to be pushed radially outwards, while the same communication orifice being coupled to a distribution orifice that is connected to the fluid discharge makes it possible to cause said piston to return-into its cylinder, towards the axis of the motor. Thus, each piston co-operates successively with the various portions of the lobes of the cam so as to enable the cylinder block and the cam to rotate relative to each other.

The spacing between the distribution orifices and the spacing being the communication orifices are such that a communication orifice is not simultaneously connected to two distribution orifices respectively connected to the fluid feed and to the fluid discharge.

While the cylinder block and the distributor are rotating relative to each other, the working chambers of the cylinders, i.e. the portions of said cylinders that are defined under the pistons, are placed alternately at high pressure and at low pressure. Therefore in said working chambers, changes in pressure generally take place at a very fast rate. Such changes in pressure subject the pistons to proportional forces, and said forces are transmitted by the pistons to the cam.

As a result, the components of the motor, in particular its casing, are subjected to the variation in load, which causes noise-generating vibration, the intensity of the noise generated depending mainly on the speed of the increases and decreases in pressure in the working chambers.

In order for the motor to operate correctly, the difference in pressure between the fluid feed and the fluid discharge is large. When a piston contributing to the drive torque reaches the end of its stroke towards its position that is furthest from the axis of the motor (top dead center), due to the communication orifice of its cylinder being connected to a distribution orifice connected to the fluid feed, the same communication orifice is isolated from said distribution orifice, and is then connected to another distribution orifice which is connected to the fluid discharge. This results in a phenomenon of pressure reduction in the cylinder of the piston in question, the fluid present at a high pressure in the cylinder being suddenly put into communication with a significantly lower pressure, which is the pressure of the fluid discharge. Conversely, when the piston reaches the bottom dead center of its stroke (its position that is closest to the axis of the motor), its cylinder is isolated from the fluid discharge, and is then connected to the fluid feed so as to enable the piston to travel over a centripetal stroke again. At this instant, the fluid contained in the cylinder goes from a low pressure to a pressure that is much higher, which is the pressure of the fluid feed. A phenomenon of pressure reduction also generally takes place, from the fluid feed, towards the cylinder. In the preceding case, the pressure reduction takes place from the cylinder towards the fluid discharge.

In both cases, the pressure reductions that take place generate jolting or juddering sensations, and noises such as knocking.

The more the quality of such motors is improved, and the greater the extent to which leaks are reduced in such motors, the more perceptible such phenomena become. In old motors, the leaks prevailing in them made it possible to avoid variations in pressure that were too sudden between the various enclosures.

An object of the present invention is to limit the phenomena of pressure reduction and the resulting jolting effects, while tending to enable the motor to operate substantially smoothly.

This object is achieved by the fact that each leading portion and each trailing portion of the edges of at least certain distribution orifices has an edge arrangement provided with at least one notch, said edge arrangements of a distribution orifice being different, the edge arrangement of a distribution orifice which is disposed in angular correspondence with the convex region of the ramp of the cam corresponding to the distribution orifice in question being suitable for allowing a pressure-compensating volume of fluid to pass through between a communication orifice and the distribution orifice that is smaller than the pressure-compensating volume of fluid that is allowed to pass by the edge arrangement of the same distribution orifice that is disposed in angular correspondence with the concave region of said ramp.

These compensation volumes of fluid are volumes of fluid capable of transiting via the notches in said edge arrangements so long as the communication between the distribution orifice and a communication orifice is established solely via the notch or notches in the edge arrangement in question.

In order to remove the above-mentioned jolting and noise phenomena, or at least in order to attenuate them considerably, the invention proposes to equip the leading portion and the trailing portion of the edge of each of at least certain distribution orifices with an edge arrangement having at least one notch.

When a piston is in contact with a convex region of a ramp of the cam, it is in a bottom position, i.e. it is in the vicinity of its bottom dead center. In this situation, the volume of the working chamber of the cylinder in which the piston moves is at its minimum.

Conversely, when the piston is in contact with the concave region of the ramp of the cam, it is in the vicinity of its top dead center and the volume of the working chamber of the cylinder in which the piston moves is at its maximum.

With the invention, when a piston is in the vicinity of its bottom dead center, the communication orifice of the cylinder of said piston leaves the trailing portion of a distribution orifice or enters into communication with the leading portion of the next distribution orifice via an edge arrangement having at least one notch suitable for passing a small pressure-compensating volume of fluid between the orifices. When the same piston is in the vicinity of its top dead center, the communication orifice of the cylinder of said piston leaves the trailing portion of a distribution orifice or enters into communication with the leading edge of the adjacent distribution orifice via an edge arrangement provided with at least one notch suitable for passing a larger volume of pressure-compensating fluid between the orifices.

Firstly, the invention makes it possible for the coupling between each communication orifice and each distribution orifice to be established gradually, either via the notch or the notches in the edge arrangement allowing a small volume to pass through and disposed on one of the edges of the distribution orifice, which arrangement is said to have a "small notch section", or via the notch or the notches in the edge arrangement allowing a large volume to pass through and disposed on the other side, which arrangement is said to have a "large notch section". This limits the above-mentioned pressure reduction phenomena.

In addition, the coupling between a communication orifice and the edge arrangement having a small notch section of a distribution orifice is established when the volume of the working chamber of the cylinder connected to the communication orifice in question is at its minimum, whereas the coupling between the same communication orifice and the edge arrangement having a large notch section of a distribution orifice is established when the volume of the working chamber of the cylinder associated with the same communication orifice is at its maximum.

By appropriately choosing the dimensions and the numbers of the notches in the edge arrangements having the small notch section and in the edge arrangements having the large notch section, it is possible make the pressure compensation between the communication orifice and the distribution orifices gradual, the extent to which the compensation is gradual being substantially the same in both of the above-mentioned situations, when considered relative to the volume of the working chamber.

Thus, by choosing a small notch section and a large notch section for the respective edges of each distribution orifice, it is possible to guarantee that the communication orifices and the distribution orifices are put into communication even more uniformly. This further improves the flexibility of motor operation, because the phenomena of pressure reduction are avoided in the same way (in the same proportions) whether the pistons are in the vicinities of their top end positions or in the vicinities of their bottom end positions. Vibration and other unpleasant jolting phenomena are further limited.

In another variant, the edge arrangement of the leading portion of at least one distribution orifice is provided with at least one notch which, relative to a notch in the edge arrangement of the trailing portion of said distribution orifice, is disposed at a different radial distance from the axis of rotation.

The fact that the two notches are situated at different radial distances from the axis of rotation can make it possible to form notches of different lengths. The different lengths are used to optimize the variation in head loss in the notch while the fluid distributor and the cylinder block are rotating relative to each other. For example, if the notch that is further from the axis of rotation and that is part of the edge arrangement having a large notch section is in communication with the communication orifice over an angular sector that is larger than the angular sector over which the edge arrangement having the small notch section is in communication with said orifice, this configuration makes it possible, while the fluid distributor and the cylinder block are rotating relative to each other, to guarantee that a communication orifice communicates for a longer lapse of time with the edge arrangement having a large notch section than with the other edge arrangement. This difference in communication time is one of the factors that make it possible to impart more uniformity to the decompression or to the compression of the volume of fluid contained in the working chamber of the cylinder block that communicates with the communication orifice in question.

Thus, the lapse of time for which the notch that is further from the axis of rotation and that is provided in the edge arrangement having the large notch section communicates with a communication orifice is generally longer because, for a given angle of relative rotation between the cylinder block and the distributor, the distance over which a point remote from the axis of rotation has to travel is longer than the distance that is traveled by a point that is closer to the axis.

Another use of the length of the notch consists, for a long notch, in limiting the communication between said notch and a communication orifice to a small portion only of the length of the notch (i.e. over a small angular sector of relative rotation between the cylinder block and the distributor), before fully-fledged communication is established with the edge itself of the distribution orifice. In which case, the long notch constitutes a constriction of long length which passes, over the small portion in question, only a small pressure-compensating volume of fluid. The long notch thus corresponds to the above-defined small notch section. The notch in the other edge of the distribution orifice, disposed at a shorter radial distance from the axis of rotation, has a shorter length but it is used over its entire length over an angular sector substantially identical to the angular sector of the limited communication between the long notch and the communication orifice before fully-fledged communication is established with the edge itself of the distribution orifice. The short notch thus passes a larger pressure-compensating volume and corresponds to the above-defined large notch section.

In which case, advantageously, for the edge arrangements of at least one distribution orifice, the distance from a short notch to the axis of rotation is smaller than the distance from a long notch to the axis of rotation.

Advantageously, for at least one distribution orifice, the edge arrangement that is disposed in angular correspondence with the concave region of the cam ramp corresponding to the distribution orifice in question is provided with at least one notch which extends over an angular sector, as measured between two radii extending from the axis of rotation, that is larger than the angular sector, as measured in the same way, over which the notch which is disposed in angular correspondence with the convex region of the ramp extends.

Advantageously, for at least one distribution orifice, the edge arrangement which is disposed in angular correspondence with the concave region of the cam ramp corresponding to said orifice has a notch section that is larger than the notch section of the edge arrangement that is disposed in angular correspondence with the convex region of the ramp.

In one embodiment, each of the edge arrangements of at least one distribution orifice has the same number of notches (advantageously a singlesnotch), the notch or notches in one of the edge arrangements being different from the notch or notches in the other edge arrangement.

In another embodiment, each of the edge arrangements of at least one distribution orifice has a similar notch or similar notches, the number of notches in one of the edge arrangements being different from the number of notches in the other edge arrangement.

The term "similar notches" is used to mean notches that have substantially the same section and that can be formed using the same tool. For example, two similar notches respectively present on the leading portion and on the trailing portion of a distribution orifice, are such that the image of one of said notches obtained by symmetry about a plane of symmetry of the distribution orifice has a shape that is identical or almost identical to the shape of the other notch.

It is thus possible to use the same tool to machine all of the notches and to choose the number of notches on each edge such as to enable the desired pressure-compensating volume to pass through them.

An advantageous variant is defined by the fact that two adjacent ramps of the cam are connected together either via a cam crest zone extending between their respective convex regions, or via a cam trough zone extending between their respective concave regions, and said cam crest zone and said cam trough zone are substantially circular arcs centered on the axis of rotation, so that when the pistons are co-operating with said zones, their radial strokes are substantially zero, and by the fact that the distribution orifices and the communication orifices have dimensions such that, while the cylinder block and the distributor are rotating relative to each other, each distribution orifice remains momentarily isolated from any communication orifice.

The cam crest zones and the cam trough zones can be referred to as "cam flats". Advantageously, the substantially zero stroke of a piston that co-operates with a cam flat is caused to coincide with the communication orifice of the cylinder of said piston being isolated from any distribution orifice. It is thus possible to avoid any significant compression or decompression of fluid in the working chamber of the cylinder block whose piston is in contact with a cam crest zone or a cam trough zone.

The invention will be well understood and its advantages will appear more clearly on reading the following detailed description of an embodiment shown by way of non-limiting example. The description refers to the accompanying drawings, in which:

FIG. 1 shows a hydraulic motor comprising a fixed casing in three portions 2A, 2B, and 2C, assembled together by bolts 3.

Figure 1:
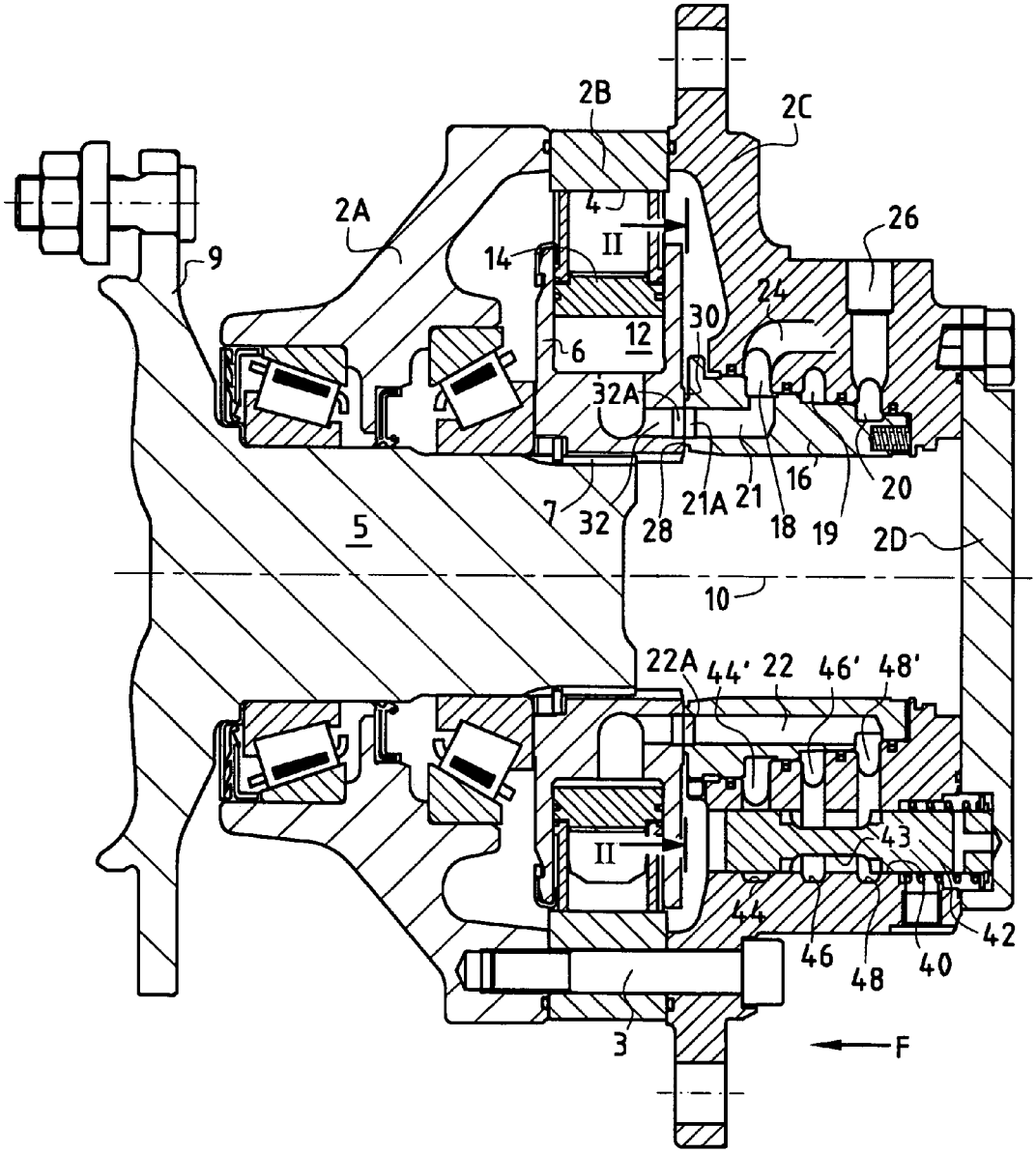
FIG. 1 is an axial section view of a hydraulic motor whose distribution orifices can be made to be in accordance with the invention.

Naturally, the invention is not limited to hydraulic motors having fixed casings, but rather it is also applicable to hydraulic motors having rotary casings and that are well known to the person skilled in the art.

The portion 2C of the casing is closed axially by a radial plate 2D that is also fixed by bolts. An undulating reaction cam 4 is formed on the portion 2B of the casing.

The motor includes a cylinder block 6 which is mounted to rotate about an axis of rotation 10 relative to the cam 4, and which comprises a plurality of radial cylinders which are suitable for being fed with fluid under pressure, and inside which the radial pistons 14 are slidably mounted.

The cylinder block 6 rotates a shaft 5 which co-operates with it via fluting 7. The shaft carries an outlet flange 9.

The motor also includes an internal fluid distributor 16 which is secured to the casing so that it is prevented from rotating relative thereto about the axis 10. Between the distributor 16 and the inside axial face of the portion 2C of the casing, distribution grooves are formed, namely a first groove 18, a second groove 19, and a third groove 20. The distribution ducts of the distributor 16 are organized in a first group of ducts which, like the duct 21, are all connected to the groove 18, a second group of ducts (not shown) which are connected to the groove 19, and a third group of ducts which, like the duct 22, are connected to the groove 20. The first groove 18 is connected to a first main duct 24 to which all of the distribution orifices of the distribution ducts of the first group, such as the orifice 21A, are connected. The third groove 20 is connected to a second main duct 26 to which all of the distribution orifices of the ducts of the third group, such as the orifice 22A of the duct 22, are connected.

Depending on the direction of rotation of the motor, the main ducts 24 and 26 are respectively a fluid exhaust duct and a fluid feed duct, or vice versa.

The distribution ducts open out in a distribution face 28 of the distributor 16, which face is in abutment against a communication face 30 of the cylinder block. Each cylinder 12 has a cylinder duct 32 that opens out in said communication face so that, while the cylinder block and the cam are rotating relative to each other, the cylinder ducts come into communication in alternation with the distribution ducts of the various groups.

The motor of FIG. 1 also includes a cubic capacity selector device which, in this example, comprises a bore 40 that extends axially in the portion 2C of the casing and in which an axially-movable selector slide 42 is disposed. The bore 40 is provided with three communication ports, respectively 44, 46, and 48, which are connected to respective ones of the grooves 18, 19, and 20, via connection ducts, respectively 44', 46', and 48'. The slide 42 is mounted to move between two end positions inside the bore 40, in which positions it causes the ports 44 and 46 or the ports 46 and 48 to communicate via its groove 43.

Figure 2:
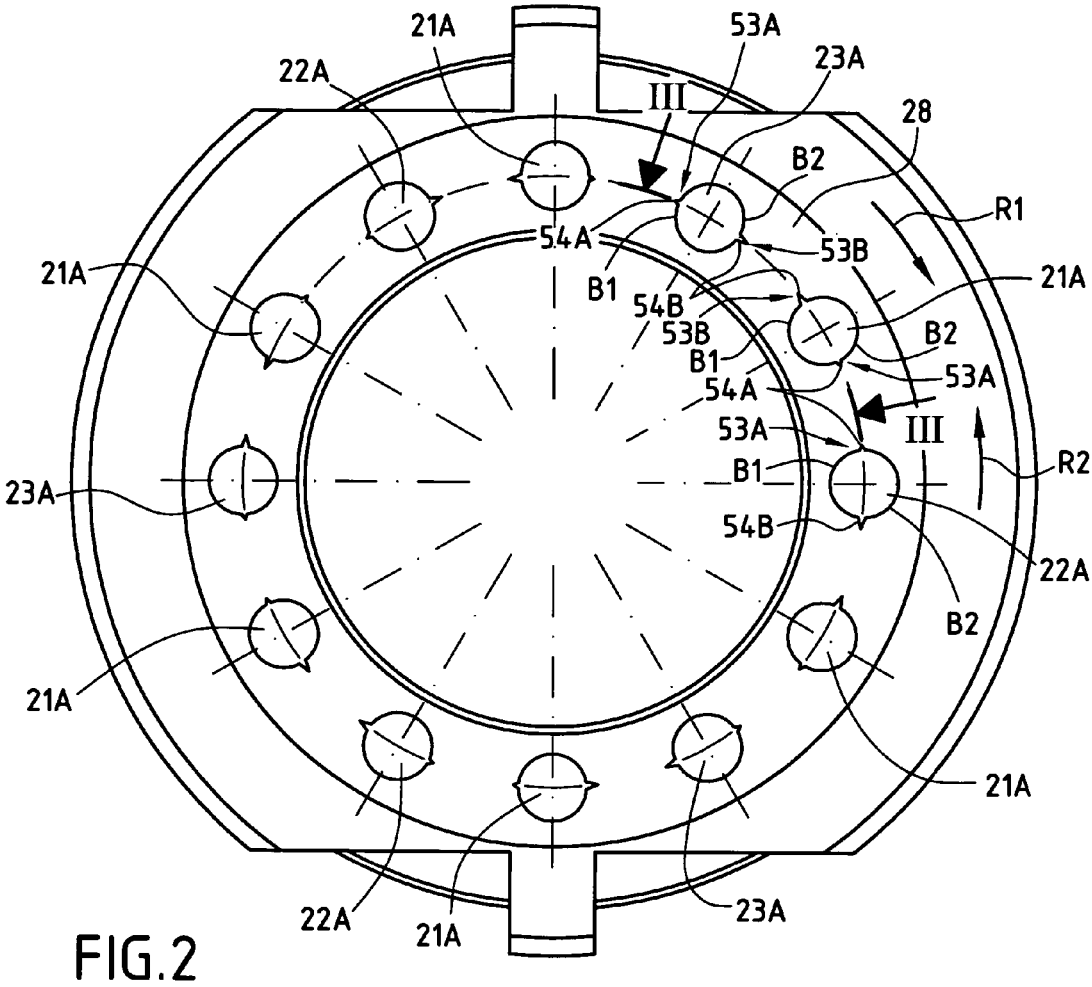
FIG. 2 is a cross-section view on line II—II of FIG. 1.

For example, as shown in FIG. 2, the distribution orifices, as considered in succession in the direction in which the cylinder block and the distributor are rotating relative to each other, comprise one pair of orifices 21A, 23A connected to respective ones of the grooves 18 and 19, and one pair of orifices 21A, 22A connected to respective ones of the grooves 18 and 20. When the selector 42 is in the position shown in FIG. 1, the grooves 19 and 20 both communicate with the fluid feed. It can be understood that, while the cylinder block and the distributor are rotating relative to each other, a communication orifice 32A is successively connected to the high pressure and to the low pressure by communicating with the orifices of the two above-mentioned pairs. When the selector 42 is moved in the direction indicated by arrow F so as to cause the grooves 18 and 19 to communicate with each other, then the two distribution orifices 21A, 23A of the first above-mentioned pair are both connected to the same pressure. Said pair is thus inactivated because, when a communication orifice goes from one to the other of the two distribution orifices of said pair, the pressure in the cylinder duct connected to said communication orifice does not change. Conversely, the next pair is active because a communication orifice communicating respectively with the two orifices 21A, 22A of said pair is placed successively at the high pressure and at the low pressure.

The situation shown in FIG. 1 is thus a large cubic capacity situation, whereas the situation in which the selector 42 is moved in the direction indicated by arrow F in order to put the grooves 18 and 19 into communication with each other is a small cubic capacity situation. In such a situation, the pairs of orifices 21A and 23A are inactive, while the pairs of orifices 21A and 22A are active.

When the cylinder block moves relative to the distributor in the direction of rotation R1 indicated in FIG. 2, the portions B1 of the edges of the distribution orifices constitute leading portions, via which a communication orifice starts being put into communication with a distribution orifice, while the portions B2 of the edges of the distribution orifices constitute trailing portions, via which the communication ceases. Naturally, when the relative rotation takes place in the opposite direction R2, it is the portions B2 that constitute the leading portions and the portions B1 that constitute the trailing portions.

In the embodiment shown in FIG. 2, each of the leading portions B1 and of the trailing portions B2 of each distribution orifice (considered in the direction of rotation R1) is provided with an edge arrangement provided with a notch. It can be seen that the notches are of different sizes, the notches 54A of the edge arrangement 53A of the edges B1 of the distribution orifices 23A and 22A, and the notches 54A of the edge arrangements 53A of the edges B2 of the orifices 21A being small notches, these edges thus having small notch sections, whereas the notches 54B of the edge arrangements 53B of the edge B2 of the distribution orifices 23A and 22A, and the notches 54B of the edge arrangements 53B of the edges B1 of the orifices 21A are large notches, these edges thus having large notch sections.

Insofar as the cam and the distributor are constrained to rotate with each other, the position of each distribution orifice relative to the lobes of the cam is fixed.

Figure 4:
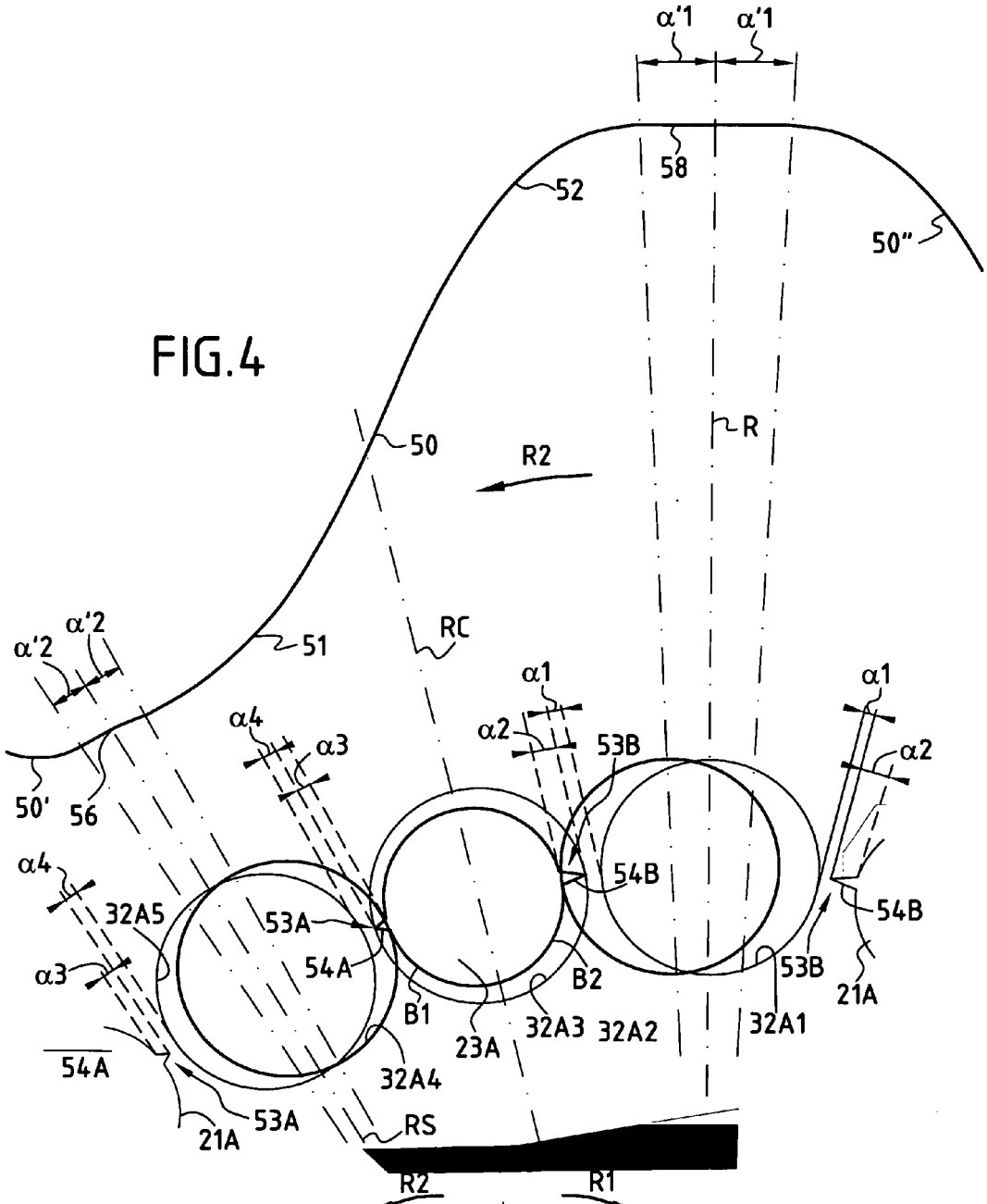
FIG. 4 shows the relative positions of a communication orifice and of a distribution orifice, while the cylinder block and the distributor are rotating relative to each other, and FIG. 4 also shows how the distribution orifice is disposed relative to a ramp of a cam lobe.

Each lobe of the cam is provided with two ramps, each of which has a convex region and a concave region. FIG. 4 shows one of the ramps 50, whose convex region, closer to the axis of rotation 10, is designated by reference 51, and whose concave region, further away from the axis, is designated by reference 52. A cam lobe is constituted by said ramp 50, and by another ramp symmetrical to the ramp 50 about the radius R passing through the axis of rotation of the motor. The adjacent cam lobe is provided with a ramp 50' symmetrical to the ramp 50 about the radius RS.

A distribution orifice is associated with each ramp of the cam. Each distribution orifice is thus angularly corresponds to a respective ramp of the cam. Although the distribution orifices are not in the same radial plane as the cam, FIG. 4 shows how a distribution orifice 23A angularly corresponds to the ramp 50 of the cam. In addition, in order to make the drawing clearer, it is out of proportion, with the communication and distribution orifices being shown closer to the cam than they really are. Substantially, the orifice 23A is disposed so that the circle within which it lies and which passes through the ends of the notches is substantially symmetrical about a radius RC of the cam, which radius intersects said cam substantially in a zone of inflection between its convex region 51 and its concave region 52.

FIG. 4 shows that the notch 54A in the portion B1 of the edge of the orifice 23A is a small notch, whereas the notch 54B in the portion B2 of the edge of the orifice 23A is a large notch. The small notch 54A is in angular correspondence with the convex potion 51 of the cam, i.e. a radius of the cam extending radially from the axis of rotation 10 of the motor and passing through the notch 54A intersects the ramp 50 in the convex region 51 thereof. The notch 54B is in angular correspondence with the concave region 52 of the ramp 50, i.e. a radius of the cam extending from the axis of rotation 10 and passing through the notch 54B intersects the ramp 50 in the concave region thereof.

FIG. 4 also shows the various positions of a communication orifice relative to the distribution orifice 23A while the cylinder block and the distributor are turning relative to each other. For example, it is considered that the cylinder block turns in the direction R2 relative to the cam, in which direction the portions B2 and B1 of the edge of the orifice 23A constitute respectively the leading portion and the trailing portion.

Firstly, a position 32A1 of the communication orifice 32A exists in which said communication orifice is isolated from any distribution orifice. It can be seen that, in this position, the orifice 32A is separated from the tip of the notch 54B of the orifice 23A by an angular distance $\alpha$1, e.g. about 1°, and it is also isolated from the notch 54B in the preceding distribution orifice 21A. When the cylinder block turns relative to the distributor in the direction R2, the communication orifice gradually comes to cover the notch 54B in the orifice 23A and, over an angular displacement $\alpha$2, e.g. through about 2°, it communicates with the distribution orifice 23A via said notch 54B only, until it takes up a position 32A2.

When the cylinder block continues to turn relative to the distributor in the direction R2, the communication orifice gradually covers the entire orifice 23A, and a positions 32A3 exists in which the distribution orifice 23A is totally covered by the communication orifice, the communication section via which the distribution orifice communicates with the communication orifice then being at its maximum.

When the cylinder block continues to turn relative to the distributor in the direction R2, the communication section decreases, and the communication orifice reaches a position 32A4 in which it communicates with the distribution orifice 23A only via the notch 54A in the edge of said orifice. It then remains for it to travel over an angular stroke $\alpha$3, e.g. of about 1°, for communication with the distribution orifice 23A to cease totally. It then remains for the communication orifice to travel over an angular stroke $\alpha$4, e.g. of about 1°, before it starts to communicate with the distribution orifice 21A that is situated after the distribution orifice 23A in the direction of rotation R2, via the notch 54A in said orifice 21A.

For the large notch 54B, when the communication orifice occupies its position 32A2, the total section of the communication passageway between said orifice and the distribution orifice 23A is larger than the section of the communication passageway which is established, via the small notch 54A, between the same distribution orifice and the communication orifice when it occupies its position 32A4.

The ratio between said sections is advantageously chosen as a function of the ratio between the volumes of the working chamber of the cylinder 12 fed via the communication orifice 32A in question when said communication orifice occupies respectively its position 32A2 and its position 32A4.

For example, the ratio between the communication sections permitted by the notches 54B and 54A is proportional to the ratio between the volume of the working chamber of the cylinder fed via the orifice 32A when said orifice is in its position 32A2 and the volume of the same working chamber when the orifice 32A is in its position 32A4.

It can be observed that the large notch 54B extends over an angular sector $\alpha 2$, measured between two radii extending from the axis of the motor, that is larger than the angular sector $\alpha 3$ (also measured between two radii extending from the axis of the motor) over which the small notch 54A extends.

The ramp 50 of the cam is connected to the adjacent ramp 50' via a cam crest zone 56 which extends between the convex region 51 of the ramp 50 and the convex region of the ramp 50', and it is connected to the other ramp that is adjacent to it, namely ramp 50", via a cam trough zone 58 which extends between the concave region 52 of the ramp 50 and the concave region of the ramp 50". The cam crest zones are the zones in which the radial distance from the cam to the axis of rotation is at its minimum, whereas the cam trough zones are the zones in which the radial distance from the cam to the axis of rotation is at its maximum.

When the orifice 32A is considered, it is observed that, between its position 32A1 and its position 32A2, said orifice travels over an angular displacement $\alpha 1+\alpha 2$ that is equal to the angle $\alpha' 1$ corresponding to a cam trough portion 58 situated on one side of the radius of symmetry R. In other words, while the cylinder block and the distributor are rotating relative to each other, when the communication orifice goes from its position 32A1 to its position 32A2, the piston of the cylinder fed by said communication orifice co-operates with the cam trough zone 58. Over a portion of this angular path, corresponding to the angular displacement $\alpha 1$, the orifice 32A is isolated from any distribution orifice. Over the remaining portion, corresponding to the displacement $\alpha 2$, it is in communication with the distribution orifice 23A via the groove 54B only.

When a piston co-operates with the cam trough zone 58, its radial stroke is zero or substantially zero. For example, it is at the most substantially equal to 0.5% of the amplitude of the stroke of the piston between its top dead center and its bottom dead center. For this purpose, the cam trough zone 58 is substantially a circular arc centered on the axis of rotation. This means that the cam trough zone is either a circular arc centered on the axis of rotation, or a region which, over the entire angular distance $2\alpha' 1$ that it covers, has a radial distance to the axis of rotation of the motor that is substantially equal to the maximum radial distance from the cam to the axis of rotation 10. Insofar as, when the communication orifice travels over the angular travel $\alpha 1$, it is isolated from any distribution orifice, the pressure in the working chamber of the cylinder fed by said orifice remains substantially constant during this displacement. The shape of the cam trough zone then makes it possible to avoid any significant compression of fluid in said chamber. Over the remaining portion $\alpha 2$ of the stroke of the communication orifice 32A, during which the piston of the cylinder fed by said orifice co-operates with the cam trough zone 58, said communication orifice communicates with the distribution orifice via the notch 54B only. Advantageous use is made of said remaining portion, over which the piston does not have to move radially, to cause the pressure in the working chamber of the piston to vary "smoothly" by means of the communication established via the notch 54B. In this example, since the orifice 23A is connected to the fluid discharge, the pressure then decreases very gradually in the working chamber, until it reaches a value close to or equal to the pressure of the orifice 23A when the communication orifice has gone beyond its position 32A2 in the direction of rotation R2, in which case the piston of the cylinder fed via said orifice co-operates with the ramp 50 and moves radially towards the axis of rotation of the motor.

The angle $\alpha' 2$ over which the portion of the cam crest zone 56 that is situated on one side of the radius of symmetry RS extends corresponds to the path traveled by the communication orifice 32A between its position 32A4 and its position 32A5, in which it is ready to start coming into communication with the distribution orifice 21A that follows the orifice 23A in the direction R2, via the small notch 54A of said distribution orifice 21A. This means that the communication orifice moves between its positions 32A4 and 32A5 while the piston of the cylinder fed via said orifice co-operates with the cam crest zone 56. While it is moving over the path $\alpha 3$, the communication orifice 32A continues to communicate with the distribution orifice 23A, but only via the small groove 54A, and then, over the path $\alpha 4$, it is isolated from any distribution orifice. The cam crest zone 56 substantially defines a circular arc centered on the axis of rotation. It can either really form such a circular arc, or else have, over the entire angular distance $2\alpha 2$ that it covers, a radial distance to the axis of rotation of the motor that is substantially equal to the minimum radial distance from the cam to the axis of rotation 10, while differing, for example, from said radial distance by at the most about 0.5%.

In the same way as for the cam trough zones 58, advantageous use is made of this situation in which the piston fed via the communication orifice 32A does not have to move radially to any significant extent, in order to open "smoothly" the coupling between said orifice and the next distribution orifice 21A.

Figure 3:
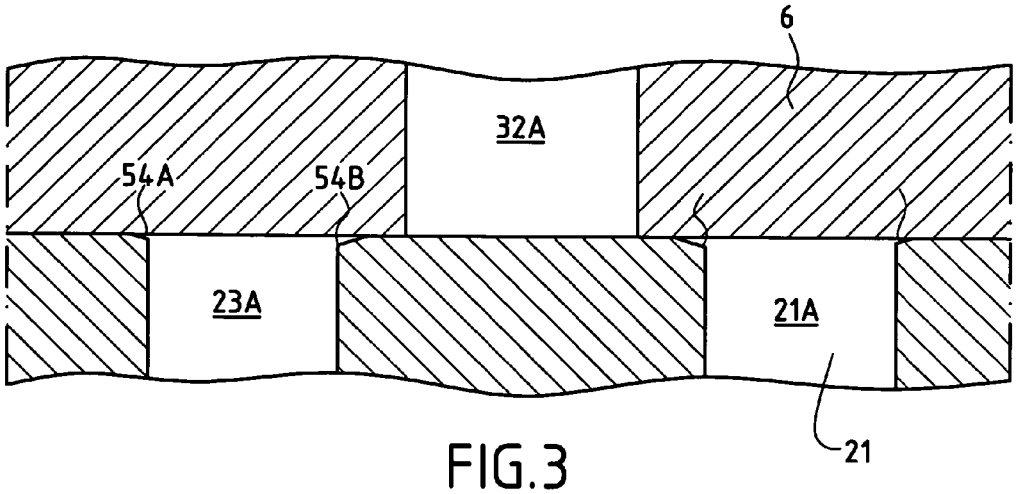
FIG. 3 is a fragmentary section view on the circular arc designated by III—III in FIG. 2.

FIG. 3 shows the position of a communication orifice 32A between two distribution orifices 23A and 21A. It can be seen that the notches 54B are longer than the notches 54A, i.e. they extend over angular travels $\alpha 2$ (see FIG. 4) that are larger than the angular travels ($\alpha 3$) over which the notches 54A extend. The notches 54B are also slightly deeper than the notches 54A.

In order to form the notches, it is possible to start from an orifice that is exactly circular and to apply a milling cutter that extends in a diametrical plane of said orifice, and that is moved axially relative thereto. If the milling cutter is circular, with a diameter slightly offset relative to the axis of the orifice in question, it is thus possible to make the notches 54B longer and deeper than the notches 54A.

In the above-described figures, the distribution orifices are circular, except for the notches 54A and 54B. It is however possible to choose distribution orifices of different shapes.

Figure 5:
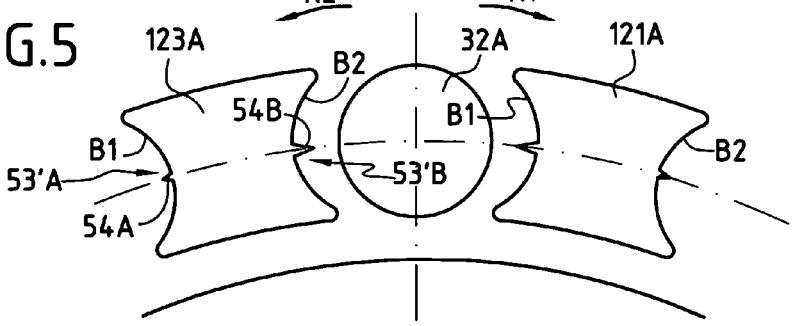
FIG. 5 shows, in a variant, a communication orifice disposed between two distribution orifices while the cylinder block an the distributor are rotating relative to each other.

Thus, FIG. 5 shows a communication orifice 32A which is circular, disposed between two distribution orifices, respectively 123A and 121A, which are non-circular. For said distribution orifices, both the leading portion (B2, if the cylinder block is turning in the direction R2 relative to the distributor and B1, if the direction of relative rotation is R1), and also the trailing portion (B1 if the relative rotation direction is R2 and B2 if the relative rotation direction is R1) are substantially convex, as seen from the inside of the orifice. Substantially, except for the edge arrangements 53'A and 53'B which are provided with the above-described notches 54A and 54B, the leading portions and the trailing portions form circular arcs which, when the distributor and the cylinder block are moving relative to each other, come to overlap the edge of a communication orifice, when said communication orifice occupies a position corresponding to the position 32A2 or to the position 32A4 shown in FIG. 4.

Thus, the distribution orifices substantially have the shapes described in Patent Application FR-A-2 587 761.

This configuration makes it possible, once communication has been established via the notches 54A or 54B, and when the relative rotation between the distributor and the cylinder block continues, to increase very rapidly the communication section over which the distribution orifices and the communication orifices communicate. Thus, by means of the notches, the above-mentioned jolting effects are avoided, but, by means of the particular shape of these distribution orifices, it is then possible for communication to be established very fast so that the efficiency of the motor is improved.

In FIG. 5, the communication orifice 32A has a substantially circular cross-section, and the above-mentioned convex shape of the edges of the distribution orifices 121A and 123A is the shape that makes it possible to increase fastest the communication between the communication orifice and the distribution orifices, after initial communication has been established via the notches 54A and 54B.

In general, it is advantageous for the leading portions and for the trailing portions of the distribution orifices to have shapes that are substantially complementary to the shapes of the edges of the communication orifices via which the communication between the distribution orifices and the communication orifices opens or closes.

Figure 6:
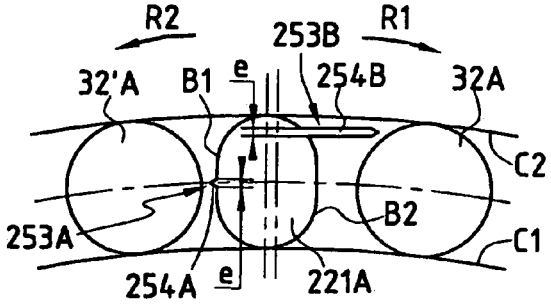
FIGS. 6 to 10 are variants, each of which shows a distribution orifice disposed between two communication orifices, while the cylinder block and the distributor are rotating relative to each other.

FIG. 6 shows a distribution orifice 221A disposed, while the cylinder block and the distributor are rotating relative to each other, between two communication orifices, respectively 32A and 32'A, while being simultaneously isolated from said two orifices.

In order to make the drawing clearer, FIG. 6 shows the circular arcs C1 and C2 between which the communication and distribution orifices are defined. If the direction in which the cylinder block and the distributor are turning relative to each other is such that the cylinder block turns in the direction R1 relative to the distributor, then the notch 254A is disposed on the leading portion B1 of the edge of the distribution orifice 221A, whereas the notch 254B is disposed on the trailing portion B2 of the edge of said orifice. It can be seen that the notches 254A and 254B of the edge arrangements 253A and 253B are disposed at different radial distances from the axis of rotation.

More precisely, the distance from the small notch 254A to the axis of rotation of the motor is smaller than the distance from the large notch 254B to said axis, and the angular sector over which the large notch limits the communication between the orifices is larger than the angular sector of the small notch. While the cylinder block and the distributor are rotating relative to each other, this makes it possible to ensure that the lapse of time for which the distribution orifice 211A communicates with the communication orifice 32A via the notch 254B only is longer than the lapse of time for which the distribution orifice communicates with the communication orifice 32'A via the notch 254A only. In addition, the length of the notch 254B, as measured tangentially relative to the axis of rotation of the motor, is longer than the length of the notch 254A.

In the example shown in FIG. 6, both of the notches 254A and 254'B have substantially the same thickness e, as measured along a radius passing through the axis of rotation of the motor.

Figure 7:
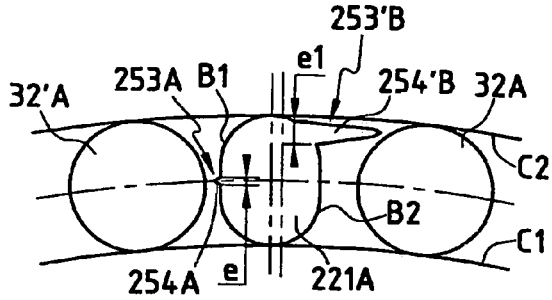

FIG. 7 differs from FIG. 6 only in that the notch 254'B of the trailing portion B2 of the distribution orifice 221A is slightly different from the notch 254B. The notch 254'B in the edge arrangement 253'B has a maximum thickness e1, as measured along a radius passing through the axis of rotation, that is greater than the thickness e, also as measured along a radius passing through the axis of rotation, of the notch 254A in the edge arrangement 253A. For example, the thickness e1 is substantially equal to twice the thickness e. Thus, the large notch 254'B forms an opening that is larger than the small notch 254A.

In FIGS. 6 and 7, the distribution orifice 221A is oblong, its largest dimension being measured along a radius passing through the axis of rotation.

Figure 8:
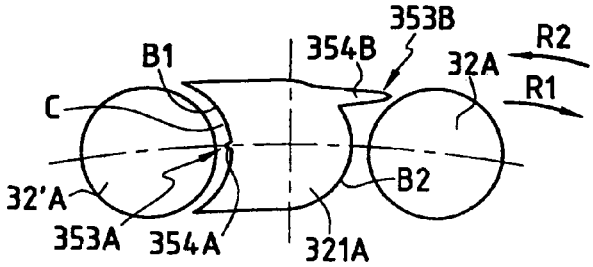

In FIG. 8, and considering that the cylinder block is turning in the direction R1 relative to the cam, the distribution orifice 321A has a trailing portion B2 whose edge arrangement 354A is provided with a notch 354B of section greater than the section of the notch 354A of the edge arrangement 353A of the leading portion B1. The trailing portion B2 of the distribution orifice is substantially in the shape of an arc of a circle whose center is situated inside said orifice.

For example, the notch 354A is analogous to the notch 254A of FIGS. 6 and 7. The leading portion B1 has a shape substantially complementary to the shape of the edge C of the communication orifice 32'A via which communication between the communication orifice and the distribution orifice opens when the cylinder block turns in the direction of rotation R1 relative to the distributor. It is also via said edge C that the communication between the distribution orifice and the communication orifice 32'A closes when the cylinder block turns relative to the distributor in the direction R2 opposite from direction R1. The leading portion B1 is convex, when it is considered from the inside of the distribution orifice 321A. It is substantially in the shape of a circular arc suitable for covering the circular arc formed by the portion C1 of the communication orifice 32'A. Thus, in the direction of rotation R1, communication between the distribution orifice 321A and the communication orifice 32'A takes place firstly via a very small section, due to the notch 354A, and then it increases very quickly because of the shape of the leading portion B1.

In the opposite direction of rotation R2, it is observed that, because of the shape of the edge B2, only a portion of the notch 354B makes communication possible via a limited section between the orifices 321A and 32A before fully-fledged communication is established between the orifices. The section of this portion of the notch 354B is larger than the section of the notch 354A.

Naturally, it is possible to equip distribution orifices substantially having the same shape as the orifice 321A with notches analogous to any of the above-mentioned notches 54A, 54B, or 254A, 254B.

Figure 9:
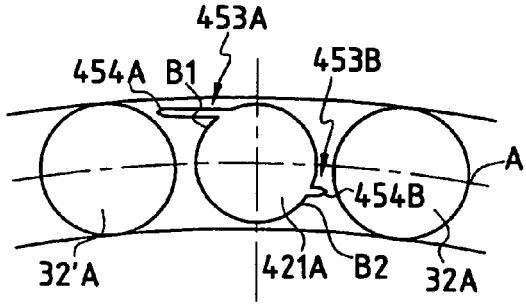

In FIG. 9, the distribution orifice 421A is substantially circular in shape except for its notches. It can be seen that the notches 454A in the edge arrangement 453A of its leading portion B1 and 454B of the edge arrangement 453B of its trailing portion B2 (in the direction of rotation R1) are situated at different radial distances from the axis of rotation of the motor. In FIGS. 6 to 8, the small notch 254A or 354A is situated substantially on an arc of a circle centered on the axis of rotation of the motor and passing through the geometrical centers of the communication orifices 32A and 32'A, whereas the large notch 254B, 254'B or 354B is situated beyond said arc of a circle, going away from the axis of rotation.

In FIG. 9, the "small" notch 454A is the notch that is longer and it is situated beyond a circular arc A passing through the geometrical centers of the communication orifices 32A and 32'A and centered on the axis of rotation, whereas the "large" notch 454B is the notch that is shorter and it is situated within said circular arc. The notes 454A and 454B have identical sections.

Disposing the longer notch 454A in this way makes it possible to limit the volume of fluid passing through the notch over the small portion of its length in communication with the communication orifice, before the fully-fledged communication is established with the edge itself of the distribution orifice. This limiting of the volume is due to the head loss generated by the long length of constriction formed by said notch. The shorter notch 454B is used over its entire length over the same angular sector centered on the axis of rotation as the angular sector of the limited communication between the long notch 454A and the communication orifice before fully-fledged communication is established with the edge itself of the distribution orifice. The notch 454B thus allows a larger pressure-compensating volume through.

The advantage of this configuration is that it is possible to keep the circular distribution and communication orifices of standard distributors (without notches) and to form the notches defined for each application as a function of the working pressures, of the rotation speeds, and of the volumes of the working chambers at the top and bottom dead centers.

In the example that has just been described, the edges of all of the distribution orifices are provided with notches, respectively on the leading portions and on the trailing portions.

In addition, as can be seen in FIG. 2, all of the large notches 54B have the same size, while all of the small notches 54A have the same size.

It is possible for only certain distribution orifices to have their edges provided with notches or else for certain distribution orifices to have notches having given dimensions that are smaller than the dimensions of the notches of the other distribution orifices.

In particular, in the description of FIGS. 1 and 2, it is indicated that the motor shown has two active operating cubic capacities, i.e. a large cubic capacity in which each pair of consecutive distribution orifices (21A, 23A; 21A, 22A) comprises one orifice (22A or 23A) connected to the fluid feed and one orifice (21A) connected to the fluid exhaust. For the motor of FIG. 1, the large cubic capacity is obtained when the selector 42 is in the position shown.

The motor also has a small active operating cubic capacity in which certain pairs of consecutive distribution orifices (21A, 22A) are active and in which each of them comprises one orifice (22A) connected to the fluid feed and one orifice (21A) connected to the fluid discharge, while other pairs of distribution orifices (21A, 23A) are inactive and each of them has both of its orifices connected to the same pressure.

When the motor is operating in the small active operating cubic capacity, and with the feed fluid flow-rate remaining the same, its speed is higher than when it operates in its large cubic capacity. However, it delivers lower torque when in its small cubic capacity.

The above-mentioned jolting or knocking phenomena are even more perceptible when the motor operates at high speed. For this reason, it is possible to make provision for only the edges of the distribution orifices of the pairs active when in the small cubic capacity to be provided with edge arrangements having notches. As described above, the notches then comprise small notches of the type of the notches 54A and large notches of the type of the notches 54B, depending on their respective positions relative to the convex and the concave regions of each cam ramp.

In an alternative manner, it is possible to make provision for the edges of the distribution orifices of the pairs that are active when in the small cubic capacity to have edge arrangements having notch sections that are larger than those of the edge arrangements of the distribution orifices of the pairs that are inactive when in the small cubic capacity. Thus, the edge arrangements of the distribution orifices of the pairs that are active in the small cubic capacity comprise one small notch and one large notch respectively disposed in angular correspondence with a convex zone and with a concave zone of the cam, whereas the edge arrangements of the orifices of the pairs that are inactive in the small cubic capacity also comprise one small notch and one large notch respectively situated facing a convex zone and concave zone of the cam, but said notches of the orifices that are inactive in the small cubic capacity are smaller than the notches of the orifices that are active in the small cubic capacity.

In the figures described above, each edge arrangement of a distribution orifice has a single notch and the small or large notch sections are obtained by choosing a small or a large notch.

Figure 10:
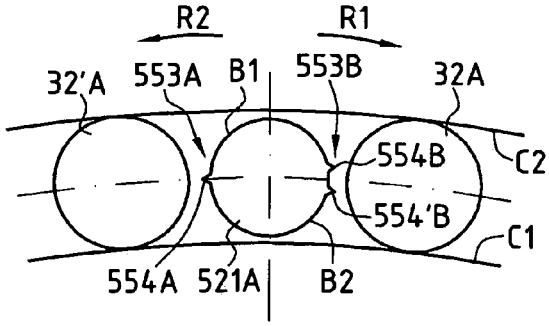

In FIG. 10, the edge arrangements 553A and 553B of the distribution orifice 521A are provided with different numbers of similar notches. The edge arrangement 553A is thus provided with a notch 554A, whereas the edge arrangement 553B is provided with two notches 554B and 554'B.

The single notch 554A thus defines, for the arrangement 553A, a notch section that is smaller than the notch section that is defined by the two notches 554B and 554'B for the arrangement 553B.

These notches can be formed using the same tool that is displaced appropriately relative to the orifice 521A.

What is claimed is:

1. A hydraulic motor having radial pistons; and comprising a cam and a cylinder block that are suitable for turning relative to each other about an axis of rotation, the cylinder block having radial cylinders connected via cylinder ducts to communication orifices situated in a communication face of the cylinder block that is perpendicular to the axis of rotation, pistons mounted to slide in the cylinders being suitable for co-operating with the cam, which cam is provided with a plurality of lobes, each of which has two ramps, each of which has a convex region and a concave region, the motor further comprising a fluid distributor having a distribution face that is perpendicular to the axis of rotation and that is suitable for being in abutment against the communication face of the cylinder block, said distribution face being provided with distribution orifices comprising orifices suitable for being connected to a fluid feed and orifices suitable for being connected to a fluid discharge, the fluid distributor being constrained to rotate with the cam, so that there is one ramp of the cam that corresponds to each distribution orifice, said distribution orifices being suitable for communicating one after another with the communication orifices while the cylinder block and the distributor are turning relative to each other, the edge of each distribution orifice having a leading portion via which communication between the distribution orifice and the communication orifices opens while the cylinder block and the distributor are turning relative to each other in a given direction of relative rotation, and a trailing portion via which communication between the distribution orifice and the communication orifices closes while the cylinder block and the distributor are turning relative to each other in said given direction of relative rotation, each leading portion and each trailing portion of the edges of at least certain distribution orifices having an edge arrangement provided with at least one notch, said edge arrangements of a distribution orifice being different, the edge arrangement of a distribution orifice which is disposed in angular correspondence with the convex region of the ramp of the cam corresponding to the distribution orifice in question being suitable for allowing a pressure-compensating volume of fluid to pass through between a communication orifice and the distribution orifice that is smaller than the pressure-compensating volume of fluid that is allowed to pass by the edge arrangement of the same distribution orifice that is disposed in angular correspondence with the concave region of said ramp.

2. A motor according to claim 1, wherein for at least certain distribution orifices, the leading portion and the trailing portion have shapes that are substantially complementary to shapes of the edges of the communication orifices via which the communication between the distribution orifices and the communication orifices open.

3. A motor according to claim 2, wherein for each distribution orifice, the leading portion and the trailing portion are substantially convex, as seen from the inside of the orifice.

4. A hydraulic motor according to claim 1, wherein the edge arrangement of the leading portion of at least one distribution orifice is provided with at least one notch which, relative to a notch in the edge arrangement of the trailing portion of the edge of said distribution orifice is disposed at a different radial distance from the axis of rotation.

5. A motor according to claim 4, wherein for the edge arrangements of at least one distribution orifice, the distance from a short notch to the axis of rotation is smaller than the distance from a long notch to the axis of rotation.

6. A motor according to claim 1, wherein for at least one distribution orifice, the edge arrangement that is disposed in angular correspondence with the concave region of the ramp is provided with at least one notch which extends over an angular sector, as measured between two radii extending from the axis of rotation, that is larger than an angular sector, as measured in the same way, over which the notch which is disposed in angular correspondence with the convex region of said ramp extends.

7. A motor according to claim 1, wherein for at least one distribution orifice, the edge arrangement which is disposed in angular correspondence with the concave region of the ramp has a notch section that is larger than the notch section of the edge arrangement that is disposed in angular correspondence with the convex region of said ramp.

8. A motor according to claim 1, wherein each of the edge arrangements of at least one distribution orifice has the same number of notches, the notch or notches in one of the edge arrangements being different from the notch or notches in the other edge arrangement.

9. A motor according to claim 1, wherein each of the edge arrangements of at least one distribution orifice has a similar notch or similar notches, the number of notches in one of the edge arrangements being different from the number of notches in the other edge arrangement.

10. A motor according to claim 1, wherein two adjacent ramps of the cam are connected together either via a cam crest zone extending between their respective convex regions, or via a cam trough zone extending between their respective concave regions, said cam crest zone and said cam trough zone being substantially circular arcs centered on the axis of rotation, so that when the pistons are co-operating with said zones, radial strokes thereof are substantially zero, and the distribution orifices and the communication orifices having dimensions such that, while the cylinder block and the distributor are rotating relative to each other, each distribution orifice remains momentarily isolated from any communication orifice.

11. A motor according to claim 10, wherein the cam crest zones extend over angular sectors, as each measured between two radii extending from the axis of rotation, that are smaller than angular sectors, as measured in the same way, over which the cam trough zones extend.

12. A motor according to claim 1, having two active operating cubic capacities, namely a large cubic capacity in which each pair of consecutive distribution orifices comprises one orifice connected to the fluid feed, and one orifice connected to the fluid discharge, and a small cubic capacity in which certain pairs of consecutive distribution orifices are active and each of them comprises one orifice connected to the fluid feed and one orifice connected to the fluid discharge, whereas other pairs of distribution orifices are inactive and each of them comprises two orifices connected to the same pressure, only the edges of the distribution orifices of the pairs that are active in the small cubic capacity being provided with notches.

13. A motor according to claim 1, having two active operating cubic capacities, namely a large cubic capacity in which each pair of consecutive distribution orifices comprises one orifice connected to the fluid feed and one orifice connected to the fluid discharge, and a small cubic capacity in which certain pairs of consecutive distribution orifices are active, and each of them comprises one orifice connected to the fluid feed and one orifice connected to the fluid discharge, whereas other pairs of distribution orifices are inactive, and each of them comprises two orifices connected to the same pressure, the edges of the distribution orifices of the pairs that are active in the small cubic capacity having edge arrangements that have notch sections that are larger than notch sections of the edge arrangements of the distribution orifice that are inactive in the small cubic capacity.

* * * * *